US006502582B1

(12) United States Patent
Peters et al.

(10) Patent No.: US 6,502,582 B1
(45) Date of Patent: Jan. 7, 2003

(54) THIN CIGARETTES HAVING FILTER ELEMENTS WITH DISTINCT RELATIVE RETENTIONS

(75) Inventors: Gunther Peters, Buchholz (DE); Sabine Schäfer, Schenefeld (DE); Solvey Knorr, Hamburg (DE)

(73) Assignee: Reemtsma Cigarettenfabriken GmbH, Hamburg (DE)

( * ) Notice: Subject to any disclaimer, the term of this patent is extended or adjusted under 35 U.S.C. 154(b) by 0 days.

(21) Appl. No.: 09/530,042

(22) PCT Filed: Oct. 15, 1998

(86) PCT No.: PCT/EP98/06524

§ 371 (c)(1),
(2), (4) Date: May 22, 2000

(87) PCT Pub. No.: WO99/21445

PCT Pub. Date: May 6, 1999

(30) Foreign Application Priority Data

Oct. 23, 1997 (DE) ..... 197 46 664

(51) Int. Cl.[7] ..... A24D 1/00

(52) U.S. Cl. ..... 131/361; 131/335; 131/336; 131/344

(58) Field of Search ..... 131/360, 365, 131/364, 361, 338, 335, 336, 341; 162/139

(56) References Cited

U.S. PATENT DOCUMENTS

| | | | | | |
|---|---|---|---|---|---|
| 4,273,141 | A | * | 6/1981 | Van Tilburg | |
| 4,564,030 | A | * | 1/1986 | Jessup et al. | 131/336 |
| 4,998,541 | A | | 3/1991 | Perfetti | |
| 5,056,537 | A | | 10/1991 | Brown | |
| 5,058,608 | A | | 10/1991 | Henning | |
| 5,592,955 | A | * | 1/1997 | Keritsis | 131/175 |
| 5,617,882 | A | * | 4/1997 | Bushuev et al. | 131/331 |
| 5,738,119 | A | * | 4/1998 | Edwards et al. | 131/331 |
| 6,089,238 | A | * | 7/2000 | Schneider et al. | 131/336 |
| 6,161,552 | A | * | 12/2000 | Case et al. | 131/365 |
| 6,206,007 | B1 | * | 3/2001 | Yoshida et al. | 131/331 |

FOREIGN PATENT DOCUMENTS

| | | | |
|---|---|---|---|
| DE | 43 32 019 A | | 3/1995 |
| EP | 0101173 | * | 2/1984 |
| EP | 0 290 911 A | | 11/1988 |
| EP | 0 413 536 A | | 2/1991 |
| EP | 0 532 329 A | | 3/1993 |
| FR | 2 619 994 A | | 3/1989 |

* cited by examiner

*Primary Examiner*—Steven P. Griffin
*Assistant Examiner*—Carlos Lopez
(74) *Attorney, Agent, or Firm*—Nixon & Vanderhye

(57) ABSTRACT

The invention relates to a filter cigarette with a tobacco strand enclosed by a cigarette paper, which has a diameter of 5–7 mm, with a smoke yield of at most 1 mg condensate, with a tobacco-side filter element having a relative retention of >90%, with a mouth-side filter element having a relative retention of <10% and with a ventilation zone running in circumferential direction in the encasing and covering paper, which is situated at a distance from the mouth-side filter end, the length of which is at least 1 mm less than that of the mouth-side cork. The nicotine/condensate ·10 strand depletion ratio is ≧1.0, the overall length of the filter lies between 25–30 mm, the diameter between 5–7 mm and the length of the mouth-side filter cork lies between 13–18 mm.

19 Claims, No Drawings

THIN CIGARETTES HAVING FILTER ELEMENTS WITH DISTINCT RELATIVE RETENTIONS

The invention relates to a thin filter cigarette with a diameter of roughly 6 mm and a length of 90 to 100 mm and a smoke yield of at most 1 mg condensate.

Thin cigarettes of these mentioned dimensions have already been known for many years, albeit not as "light" or as "ultra-light" cigarettes but with packing densities and drawing resistances and also paper porosities which in no way achieve the values of a present-day ultra-light cigarette with 0.1 mg nicotine/1 mg condensate. Specialists have hitherto believed that an ultra-light cigarette could not even be made with smaller diameters than 8 or 7 mm.

The object of the invention is to create a thin filter cigarette with a diameter of roughly 6 mm which is to be unequivocally classified as an ultra-light cigarette on the basis of its nicotine/condensate values of 0.1/1 and which achieves a customary drawing coefficient during smoking.

The invention is explained in more detail below with the help of examples:

While a tobacco strand of 5–7 mm in diameter and a packing density within a range of 100–200 mg/cm$^3$ may be provided, a tobacco strand with a diameter of 6.1 mm was manufactured, its packing density being 184 mg/cm$^3$. The length of the tobacco strand was 70 mm. The tobacco strand was packed such that a drawing resistance of 100 daPa (deca pascal) resulted, a suitable range being 80 to 120 daPa. A cigarette paper with a porosity of 24 CORESTA units (CU) was chosen as casing for the tobacco strand. A suitable range would be 8 to 60 CORESTA units. The expanded tobacco content of the tobacco, as measured by the so-called INCOM method, was 55%. In other versions, the expanded tobacco content can lie between 40 and 100%. "Expanded" tobacco refers to a tobacco which is produced by the expansion method in accordance with DE-PS 29 03 300, 31 19 330 or 34 14 625. These methods are also called "INCOM methods". The above parameters may, however, be varied. For example, the tobacco strand may have a length between 65 and 75 mm.

The tobacco strand has a drawing resistance of 0.7 to 1.7 daPa/cm.

A double filter without cavity was attached to the thus-manufactured tobacco strand, the strand-side filter section consisting of paper, containing up to 100% spun cellulose fibers, and the mouth-side filter section of cellulose acetate. The overall length of the double filter was 27 mm, the length of the strand-side paper filter being 12 mm and the length of the mouth-side cellulose acetate filter 15 mm. Two rows of laser perforations, via which ventilation air can be introduced into the filter, ran through the casing at a distance of 12 and 13 mm from the mouth-side end of the cellulose acetate filter and thus at a distance of 2 and 3 mm respectively from the paper filter section. Since the perforation lines are situated in the area of the cellulose acetate filter section, the ventilation air flows only through this section and thus does not influence the flow through the paper section. The result of this is that the flow of the mainstream smoke through the paper filter section is relatively laminar, and a good nicotine and condensate reduction can take place. In the adjoining cellulose acetate filter section, on the other hand, the mainstream smoke is whirled by the ventilation air, which contributes to a clear improvement in taste.

A further result of the combination of a paper filter with a cellulose acetate filter is that the smoked-out cigarettes are much better biologically degradable, since more than half of the cigarette butt requiring disposal consists of biologically degradable material.

It will be appreciated that, while Table 1 gives a preferred relative retention of 92% and 8% for the tobacco-side filter element and mouth-side filter element, respectively, the relative retention of the tobacco-side filter and the mouth-side filter may be greater than 90% and less than 10%. Also, the nicotine/condensate −10 strand depletion ratio may be equal to or greater than 1.0, the exemplary ratio of 7.6 being given in Table 1. Further, while Table 1 gives an exemplary length of the filter as 27 mm and the mouth-side filter as 15 mm, the filter length may lie in a range of 25 mm–30 mm in length and the length of the mouth-side filter may lie in a range of 13–18 mm. The degree of ventilation may also lie in a range of 70–95%. Further, the tobacco-side filter element and the mouth-side filter element may have a drawing resistance of at most 60 daPa/cm and 30 daPa/cm, respectively. The mouth-side filter may have an individual denier value of at least 5–8 and a filament cross-section in the shape of a Y. The mouth-side filter may have an overall denier value of at least 15,000 to 20,000. Also, a preferred cigarette paper has an area weight of 20 to 50 g/m$^2$ (See the examples in Table 3).

The individual parameters of the embodiments are reproduced at the end of the description in the form of Tables 1 to 4.

Cigarette smoking is increasingly criticized, since non-smokers in particular feel disturbed by the smoke and its smell. The cigarette according to the invention from Example 1 already shows clear advantages here compared with most cigarettes customary in the trade, as they give rise to ca. 40% less sidestream smoke because of their low smoked tobacco weight alone, and thus lead to correspondingly less smoky premises, a lesser impression of smell in the area, both fresh and stale, and a reduced smell on clothes, hair and items of furniture such as curtains, carpets etc. (see Table 4) .

Sidestream smoke refers to the smoke which rises from the zone in front of the glowing tip as the cigarette burns. Distributed in the ambient air, it is customary to also call this smoke "environmental tobacco smoke" (ETS) or "second-hand smoke". In order to compare the amount of smoke which is given off into the ambient air by tobacco products during smoking, it is customary to smoke a defined number of specimens of the study sample in question in an area with defined volume and suitable devices for taking samples for the measurement. The amount of smoke can e.g. be determined by precipitation of the smoke particles on a piezobalance from a defined sample volume. The particle masses measured by this method are in each case given in Table 4 as the average of three measurements, in order to carry out a comparison of the amounts of smoke produced by the embodiments of the cigarettes according to the invention with comparison cigarettes customary in the trade.

Following on from the sampling, the area was assessed for appearance and smell by subjects of a trained panel (i.e. a group) comprising smokers and non-smokers. The subjects rated their impression with the help of the optical test criterion "degree of smokiness" and the smell-related test criterion "smells of cigarette smoke" on a scale from 0 to 100. The numerical results of this sensory test were statistically evaluated, compressed into groups and assigned to the following definition scaling of the test criteria "smokiness" and "smells of cigarette smoke": none . . . , a little . . . , not much . . . , pronounced . . . , very pronounced. The results are listed in columns 4 and 5 of Table 4. The embodiment displays a lesser smoke impression than cigarettes customary in the trade, both quantitatively (−43%) and qualitatively.

A further improvement is obtained if the tobacco strand from Example 1 is encased in special papers, such as are to be obtained e.g. from Ecusta, Pisgah Forest, N.C., U.S.A. The papers can be used in different efficiency steps (papers NS1 to NS3 with increasing area weight). Possible versions are Examples 2a to 2c, the field of use determining whether the user chooses a less effective paper such as NS1, which does not differ from standard papers optically and in terms of processability, or decides on papers with a greater efficiency, which also, as the area weight increases, give the consumer an optical signal (thicker, whiter) that a special paper is being used. The optical smoke impression is clearly reduced by Examples 2a–c (see Table 4). In terms of taste, the examples are rated as equivalent compared with Example 1 by experts and the subjects of the smoke panel and in the case of Example 2a are preferred as being fuller and more aromatic.

The smell of the smoke is also felt somewhat less than that from the comparison cigarettes customary in the trade for the Examples 2a–c in its intensity. A further improvement is possible by applying to a second layer of the strand casing aromas which positively influence the smell of the smoke, as is described for example in patent specification DE 42 44 467. The use examples 3a and 3b manufactured in this way (tobacco strand, filter and the physical and analytical data corresponding to Example 1) show a significant reduction in the assessment test criterion "smells of cigarette smoke" (see Table 4).

A further possibility of reducing the quantitative amount of smoke is realized in Example 4, by expanding the tobacco mixture from Example 1 by 100%. A tobacco weight below 300 mg is thereby achieved, plus a reduction of almost 80% in the particle mass compared with cigarettes customary in the trade. A reduction of over 60% is even achieved compared with a cigarette of the same format, as described in Example 1.

In some markets (among others Japan, Korea and Hungary) smokers prefer cigarettes which contain activated carbon. The activated carbon is usually introduced into the tobacco-side filter element. Compared with cigarettes without activated carbon, experts agree in describing them as milder and softer. This rests on the activated carbon's ability to adsorb substances of the gas phase, such as e.g. acrolein or acetaldehyde, in the period during which the smoke flows through the filter. In two further versions, with the cigarette described in Example 1, the strand-side filter cork made from paper was impacted by activated carbon up to a proportion by weight of 50%. The application of the activated carbon can take place in two ways in principle:

Firstly by sprinkling the activated carbon on during the manufacture of the paper base rod for the double filter; binders or adhesion promoters can additionally be used for a more regular distribution of the particles.

Secondly by introducing very finely reduced activated carbon particles during the paper manufacturing process, which leads to an extremely regular distribution of the particles and a very effective utilization (relative to the quantity by weight used) of the pore volume available.

In another version, 30 mg of activated carbon were applied by the first method and a 50% reduction of the afore-mentioned substances of the gas phase was achieved. If the same amount of activated carbon is applied by the second method, a reduction (relative to Example 1) of 90% is achieved.

TABLE 1

| | | Embodiment | | | | |
|---|---|---|---|---|---|---|
| | | tobacco side | Filter | mouth side | Strand | Whole cigarette |
| Diameter | mm | | 6.05 | | 6.1 | 6.1 |
| Length | mm | 12 | | 15 | 70 | 97 |
| Drawing resistance | daPa | 55 | | 30 | 100 | 53 |
| Retention | abs. % | 74 | | 26 | | 81 |
| | rel. % | 92 | | 8 | | |
| | partial % | 74 | | 7 | | |
| Filament | den | — | | 6.0 y - 17,000 | | |
| Tobacco weight | mg | | | | 378 | |
| Packing density | mg/cm$^3$ | | | | 184 | |
| Expanded tobacco content | % | | | | 55 | |
| Cigarette paper porosity | Coresta | | | | 24 | |
| Ventilation | % | | | | | 86 |
| Condensate | mg/cig. | | | | | 1.0 |
| Nicotine | mg/cig. | | | | | 0.14 |
| N/C · 10 | | | | | | 1.4 |
| zz | | | | | | 7.6 |

TABLE 2

| Description of the embodiments | | | | | | | |
|---|---|---|---|---|---|---|---|
| | Structure of | | Expand. | | Smoke analysis according to ISO | | |
| No. of the Example | the strand casing | Paper designation | tobacco content [%] | Tobacco weight [mg] | Drawing Coeff. | K [mg/C] | N [mg/C] |
| 1 | | C24 | 55 | 378 | 7.6 | 1.0 | 0.14 |
| 2a | single | NS1 | | | 7.7 | 0.9 | 0.13 |
| 2b | layer | NS2 | | | 8.6 | 1.0 | 0.15 |
| 2c | | NS3 | | | 9.2 | 1.0 | 0.14 |

TABLE 2-continued

Description of the embodiments

| No. of the Example | Structure of the strand casing | Paper designation | Expand. tobacco content [%] | Tobacco weight [mg] | Smoke analysis according to ISO Drawing Coeff. | K [mg/C] | N [mg/C] |
|---|---|---|---|---|---|---|---|
| 3a | 2-layer inside<br>outside | PO204A<br>NS1 | | | 7.7 | 0.8 | 0.10 |
| 3b | 2-layer inside<br>outside | NS1<br>C40A | | | | | |
| 4 | single-layer | NS3 | 100 | 268 | 6.5 | 0.9 | 0.12 |

NB: Format and filter structure are described in Table 1.

TABLE 3

Description of the cigarette papers used

| Designation | Area weight G/m$^2$ | Filler Type | Filler Content [%] | Glow salt Content [%] - Type | Porosity [CU] |
|---|---|---|---|---|---|
| C24 | 24 | $CaCO_3$ | 31 | 0.7% Na acetate | 24 |
| NS1 | 27 | | | | 18 |
| NS2 | 38 | $CaCO_3$ | 31 | 3.6% Na acetate<br>4.6% K citrate | 15 |
| NS3 | 47 | $Mg(OH)_2$ | 10 | 5.7% Na citrate<br>5.6% M citrate | 17 |
| C40A | 24 | $CaCO_3$ | 31 | 0.7% N acetate | 40 |
| PO204A | 20 | — | — | — | 24000 |

TABLE 4

Quantitative and qualitative assessment of the sidestream smoke

| Designation of the sample or embodiment | Particle mass [mg/cig.] | Reduction vs comparison [%] | Panel's rating 'smokiness' | 'smells of cigarette smoke' |
|---|---|---|---|---|
| 1 | 8.5 | 43 | Moderate | Moderately |
| 2a | 5.6 | 63 | Not a lot | Moderately |
| 2b | 4.4 | 71 | Not a lot | Moderately |
| 2c | 4.1 | 73 | Low | Moderately |
| 3a | 4.6 | 69 | Not a lot | Not a lot |
| 3b | 4.5 | 70 | Not a lot | Not a lot |
| 4 | 3.3 | 78 | Low | Not a lot |
| Comparison Branded cigarettes[1] | 15 | 0 | Pronounced | Strongly |

[1]The 6 biggest-selling king-size branded cigarettes on the German market in 1996 were studied. The figure given is the average of n = 3 studies each per brand. The averages for the individual brands range from 12.4 to 17.2.

What is claimed is:

1. A filter cigarette comprising:

a) a tobacco strand enclosed by a cigarette paper having a diameter of 5–7 mm, b) said cigarette having a smoke yield of 1 mg or less condensate, c) a tobacco-side filter element having a relative retention of >90%, d) a mouth side filter element abutting said tobacco-side filter element and having a casing and a relative retention of <10%, e) circumferentially spaced perforations through a casing of the mouth-side filter element defining a ventilation zone in the mouth-side filter element, said perforations and ventilation zone being spaced from opposite ends of the mouth-side filter element and located a distance at least 1 mm from an abutting end of said tobacco-side filter element, f) said tobacco strand having a nicotine/condensate ·10 strand depletion ratio >1.0, g) said tobacco-side filter element and said mouth-side filter element having a combined overall length between 25–30 mm and a diameter between 5–7 mm, and h) the length of the mouth-side filter element lying between 13–18 mm.

2. A filter cigarette according to claim 1, wherein the degree of ventilation is between 70 and 95%.

3. A filter cigarette according to claim 2, wherein the ventilation openings are produced by a laser on-line perforation in a circumferential direction.

4. A filter cigarette according to claim 3, wherein the laser on-line perforations are produced in two rows.

5. A filter cigarette according to claim 1, wherein the tobacco-side filter element comprises a paper material containing up to 100% spun cellulose fibers.

6. A filter cigarette according to claim 1, wherein said tobacco-side filter element comprises a paper material containing up to 50 wt. % activated carbon.

7. A filter cigarette according to claim 1, wherein said tobacco-side filter element has a drawing resistance of at most 60 daPa/cm.

8. A filter cigarette according to claim 1, wherein the mouth-side filter element has a drawing resistance of at least 30 daPa/cm.

9. A filter cigarette according to claim 1, wherein the mouth-side filter element has an individual denier value of at least 5 to 8 and a filament cross-section in the shape of a Y.

10. A filter cigarette according to claim 1, wherein the mouth-side filter element has an overall denier value of at least 15,000 to 20,000.

11. A filter cigarette according to claim 1, wherein the tobacco strand has a packing density of 100–200 mg/cm$^3$.

12. A filter cigarette according to claim 1, wherein the tobacco strand has a length of 65 to 75 mm.

13. A filter cigarette according to claim 1, wherein the tobacco strand contains at least 40 to 100% expanded tobacco.

14. A filter cigarette according to claim 1, wherein the paper encasing the tobacco strand has an air permeability of 8 to 60 coresta.

15. A filter cigarette according to claim 1, wherein the paper encasing the tobacco strand has an air permeability of 24 coresta.

16. A filter cigarette according to claim 1, wherein the cigarette paper reduces the visible side stream smoke and has an air permeability of ≦20 coresta.

17. A filter cigarette according to claim 1, wherein the cigarette paper has an area weight of 20 to 50 g/m$^2$.

18. A filter cigarette according to claim 1, wherein the cigarette paper contains 20 to 50 wt. % filler.

19. A filter cigarette according to claim 1, wherein the tobacco strand has a drawing resistance of 0.7 to 1.7 daPa/mm.

* * * * *